United States Patent [19]

Linnemann

[11] Patent Number: 4,771,885

[45] Date of Patent: Sep. 20, 1988

[54] SKID TOP

[75] Inventor: Kent A. Linnemann, Cincinnati, Ohio

[73] Assignee: Shippers Paper Products Company, Loveland, Ohio

[21] Appl. No.: 946,858

[22] Filed: Dec. 29, 1986

[51] Int. Cl.[4] ..... B65D 5/64

[52] U.S. Cl. ..... 206/386; 206/521; 229/23 R; 229/199

[58] Field of Search ..... 108/51.3, 55.3, 55.1; 206/320, 521, 386, 595–600; 229/23 A, 23 AB, 23 BT, 23 R, 43, 199

[56] References Cited

U.S. PATENT DOCUMENTS

| | | | |
|---|---|---|---|
| 2,164,506 | 7/1939 | Enrich | 229/23 A |
| 3,931,923 | 1/1976 | Thurston | 229/23 R |
| 4,030,600 | 6/1977 | Heaps | 229/23 A |
| 4,133,474 | 1/1979 | Hall | 229/23 R |
| 4,391,371 | 7/1983 | Sieffert | 206/600 |
| 4,545,482 | 10/1985 | Novatny | 206/599 |

FOREIGN PATENT DOCUMENTS

| | | | |
|---|---|---|---|
| 0973103 | 8/1975 | Canada | 206/320 |

*Primary Examiner*—Jimmy G. Foster

*Attorney, Agent, or Firm*—Wood, Herron & Evans

[57] ABSTRACT

A skid top for protecting a skid load of material includes a paperboard sheet having a planar dimension generally corresponding to the length and width of the skid load upon which it is to be used and a peripheral frame laminated thereto formed of laminated paperboard members folded upon themselves and laminated to themselves. In a presently preferred form, the paperboard sheet includes side flaps adapted to be bent down over the top edge of the skid load and paperboard slats laminated to the side flaps. The invention is characterized in part by its improved design, light weight, ease of handling, economies of manufacture, and the improved protection it provides to skid loads.

6 Claims, 4 Drawing Sheets

SKID TOP

BACKGROUND OF THE INVENTION

In the shipment of the wide variety of materials and articles of manufacture, a pallet load of material often is accumulated and placed on a wooden skid or pallet such that it may be picked up and moved by a standard fork-lift truck. The load is secured to the pallet by means of tensioned high strength steel or plastic strapping passing over the load and down around the pallet. Material which is shipped in this manner spans the gamut from fine paper to printed products, such as newspapers, advertising inserts and magazines, to boxed, cartoned or otherwise packaged goods, such as bottles, cans and boxes. The range of different goods and applications handled in this manner is virtually limitless. In each case, the load must be protected both from the force of the tensioned strapping itself passing over the edges of the load and damage from knocking, denting, and abrasion with adjacent loads or with the truck or railway car in which the load is shipped.

Protection of the load has been provided in the prior art by forming a wooden frame having a length and width generally corresponding to the length and width of the skid. The wooden frame is placed on top of the load and the strapping passed over the edges. The use of wood has a number of disadvantages including the accumulation of dirt and the presence of moisture which can transfer to the load. Moreover, wood is heavy increasing the shipping weight, bulky taking considerable room to store, unwieldy making it hard to handle, and expensive. Further, the wood frames do not provide complete protection to the top of the load; and, even where a separate sheet or moisture barrier material is provided to protect the top of the load, provides no protection whatever to the sides of the load at the top edges.

Some shippers have substituted the use of rigid preformed paperboard angles for the wood frames. In this application, laminated paperboard which is glued, treated and formed into rigid right angles is either glued or stapled into a frame which fits down around the top of the skid load. A single sheet of paperboard may be interposed between this frame and the top of the load to provide protection to the top of the load. The strapping is then passed over the right angle to secure the load to the skid. This particular form of corner protection has advantages over the use of a wood frame in that it cushions the load edges against hard knocks and strap indentation, replaces expensive lumber, and provides for some protection of the top side edge of the load. On the other hand, the use of such paperboard angles has a number of disadvantages in comparison to the present invention in that additional labor is required to form the angles into a frame and handling problems are encountered in the moving and placing of that frame about the top of the skid load. All in all, such angles are relatively unwieldy to assemble and to place on the load and require additional labor.

SUMMARY OF THE INVENTION

It is among the principal objectives of this invention to provide an improved skid top overcoming the disadvantages and objections inherent in the use of the wooden frames described above and in assembled pieces of preformed paperboard angles. In its general aspect, the present invention includes a paperboard sheet of planar dimension generally corresponding to the length and width of the skid load upon which it is to be used and a peripheral frame of paperboard slats laminated to the marginal side portion of the paperboard sheet. The paperboard slats are made from multiple plies of laminated paperboard which are then folded over and laminated to themselves to provide a paperboard slat having excellent beam strength as well as a rounded edge at the fold providing a rigid edge to resist indentation by the tensioned straps securing the load to the skid.

In one presently preferred form of the invention, the paperboard sheet includes side flaps hinged thereto which are adapted to be bent downwardly around the top side edge of the load. Paperboard slats like those adhered to the planar face of the paperboard sheet are laminated to these flaps to provide substantially improved cushioning of the load edges against hard knocks and strap indentation as well as abrasion from adjacent loads during handling, storage, and shipping.

The present invention provides a skid top which is substantially lighter than the wooden frame, e.g., on the order of 10 pounds versus 50 to 80 pounds. It is also cleaner in that it does not trap dirt and does not have a moisture problem as wood frames do. It requires less room to store and protects the product better particularly in the critical area of the top side edge where an adjoining skid or transportation vehicle such as a trailer or railway car can abrade or damage the load at the top of the skid. Moreover, the paperboard can be coated with a moisture resistant compound or polyethylene can be extruded on it. Therefore, there is no need to place a separate moisture barrier between the top of the load and the skid top thereby providing better protection and saving assembly time.

Still further, the skid top of the present invention provides a large labor savings over the stapling of preformed angles into a frame and is substantially easier to handle and place on the top of the load. In the embodiment including the side flaps to be bent down around the top side edges of the load, the strength of the two paperboard slats laminated to the underlying paperboard sheet provides substantial strength at the apex to resist strap indentation allowing the straps to be tensioned tightly without damaging the product.

In addition, the present invention is characterized by a wide degree of flexibility in design. As stated above, the skid top can be manufactured either with or without side flaps depending on application. The particular form of the paperboard frame laminated to the underlying paperboard sheet may be modified to add additional members and place their joints in any configuration to best resist the tension of the straps. The skid top can be manufactured such that the paperboard frame and side flaps with paperboard slats laminated thereto can be on the outside of the load or inverted and placed adjacent the load as desired for a particular application.

In summary, the present invention provides a substantially improved skid top for protecting a skid load of material which is cleaner, lighter in weight, more economical to manufacture, which provides better protection, and which saves time in handling and application than heretofore available in the prior art.

DETAILED DESCRIPTION OF THE INVENTION

Figure 1:
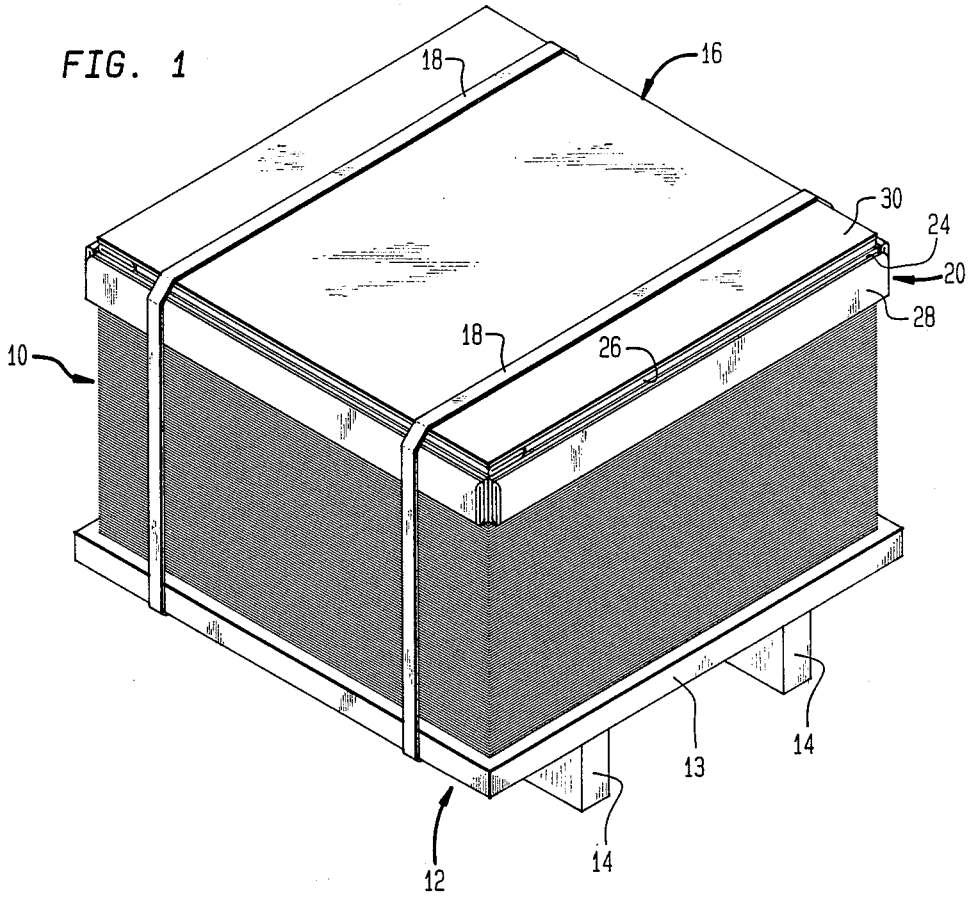
FIG. 1 is an isometric pictorial view illustrating the environment and application of the skid top of the present invention to a skid load.

Referring now to FIG. 1, there is illustrated a skid load 10 of a stack of material such as a stack of fine paper. The paper is stacked on a wooden skid 12 which includes a pallet 13 and underlying wooden cross members 14 permitting the tines of a forklift truck to be inserted below the pallet 13 for lifting of the skid load 10. A skid top 16 is placed on top of the stack of paper and, in the embodiment illustrated in FIG. 1, includes side flaps 20 which are bent down to cover the top side edges of the stack. Tensioned straps 18 pass over the skid top 16 and down around the skid load 10 to secure the skid top 16 and stack of paper tightly to the wooden skid 12.

Figure 2:
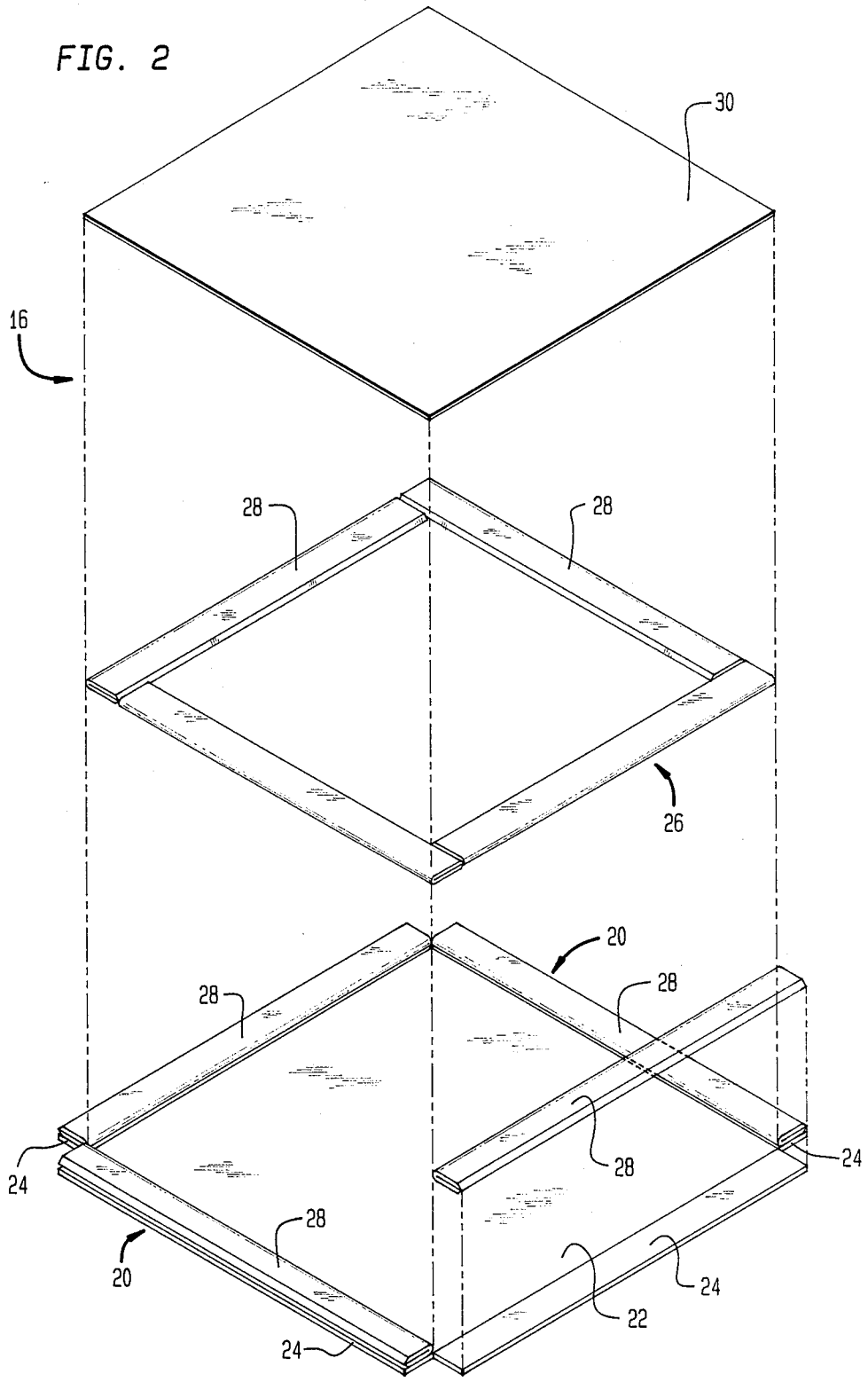
FIG. 2 is an exploded isometrical pictorial view showing the construction of one form of skid top, i.e., that shown in FIG. 1.

Referring in addition to FIG. 2, the skid top 16 is shown in more detail. The top includes a paperboard sheet 22 having an overall planar dimension generally corresponding to the length and width of the skid load upon which it is to be used. The paperboard sheet 22 includes four side portions 24 integrally hinged thereto which with slats 28 hereinafter described form side flaps 20 adapted to be bent downwardly about the top of the load as shown in FIG. 1. The paperboard sheet 22 can be either laminated or unlaminated depending on the particular application. Generally, the thickness of the sheet is in the range of 0.09 to 0.60 inch. The sheet may be either uncoated or coated with a moisture resistant material to protect the top of the load. Alternatively, a coating of polyethylene can be extruded on the surface of the paperboard to provide a moisture barrier. The width of the side flap portions 24 is generally on the order of 2 to 3 inches to protect that portion of the top of the load 10.

A peripheral frame 26 is formed of paperboard slats 28. These slats 28 are laminated to the top of the paperboard sheet 22 around a peripheral edge to form the rigid frame 26. There is no need to join the paperboard slats 28 to each other at their joints as the individual slats 28 are adhered to the surface of sheet 22. However, they can be joined if desired.

A top paperboard sheet 30 having generally the same dimensions as the bottom sheet 22 is then placed upon the frame 26 and laminated thereto sandwiching the frame 26 between two sheets of paperboard 22, 30. The top sheet 30 may be of the same thickness and weight as the bottom sheet 22 and again may be coated with a waterproof material to protect the top of the skid load. Optionally, the top sheet can be dispensed with altogether and the skid top formed solely of the paperboard sheet 22 and the frame 26 laminated to the top surface thereof.

Paperboard slats 28 are likewise laminated to the side flap portions 24 as shown in FIG. 2. These slats 28 substantially reinforce the side flap portions 24.

Figure 4A:
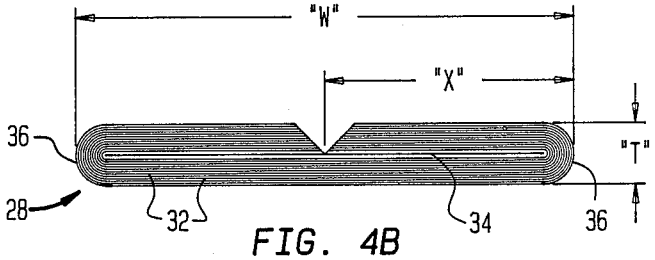
FIGS. 4A and 4B are schematic end views showing the construction of the paperboard slats used in the present invention.
Figure 4B:
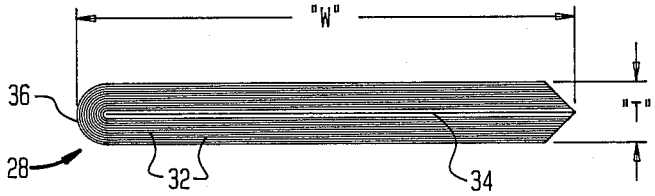

Referring now to FIGS. 4A and 4B, the construction of the paperboard slats 28 is shown in more detail. The paperboard slat 28 may be formed of various configurations. Two alternatives are illustrated by FIGS. 4A and 4B, respectively. In each embodiment, multiple plies 32 of paperboard are laminated and glued together. This laminated paperboard is then folded upon itself and glued thereto along a line 34 to provide a slat having a width "W" and thickness "T". As seen, the slat 28 has at least one rounded edge 36 (FIG. 4B) or a pair of rounded edges 36 (FIG. 4A). Although the slat 28 could be formed of a width "W" merely by laying up and laminating multiple plies of paperboard of width "W", it has been found that exceptional beam strength in the slat is provided by first forming the multiple plies and then folding the element upon itself and gluing it to itself along line 34. This fold gives the slat more strength using the same amount of paper or the same strength with less paper then merely laminating multiple plies.

In FIG. 4A, the slat 28 is formed by folding two side edges of width "X" ("X"="W"/2) and thickness "T"/2 together and laminating them to the center section to provide an overall width "W" and thickness "T". In a presently preferred form of the invention, the dimension "W" is on the order of 1½to 4 inches and the thickness "T" from about 0.040–0.050 inch to 0.04 inch.

It has been found that the embodiment shown in FIG. 4A has certain advantages over that shown in FIG. 4B in that the double fold tends to lessen warpage and give a more even product. Additionally, in the embodiment shown in FIG. 4A, a single sheet of paperboard may be placed over the top surface to provide uniformity or the outer paperboard ply of one of the folded portions can be extended over the other folded portion.

Referring back to FIGS. 1 and 2, the paperboard slats 28 are laminated to the marginal side portions of the paperboard sheet 22 to form a peripheral frame 26 and to the side flaps 24. Preferably, the rounded edge 36 created on folding is disposed toward the hinge of the paperboard joining flaps 24 to sheet 22. As is known in the art, the tension applied to the straps 18 securing the load to the skid can be very high tending to cut into the load. The paperboard slats 28 having folded edges 36 at their apexes have been found to provide excellent resistance to strap indentation.

Figure 3:
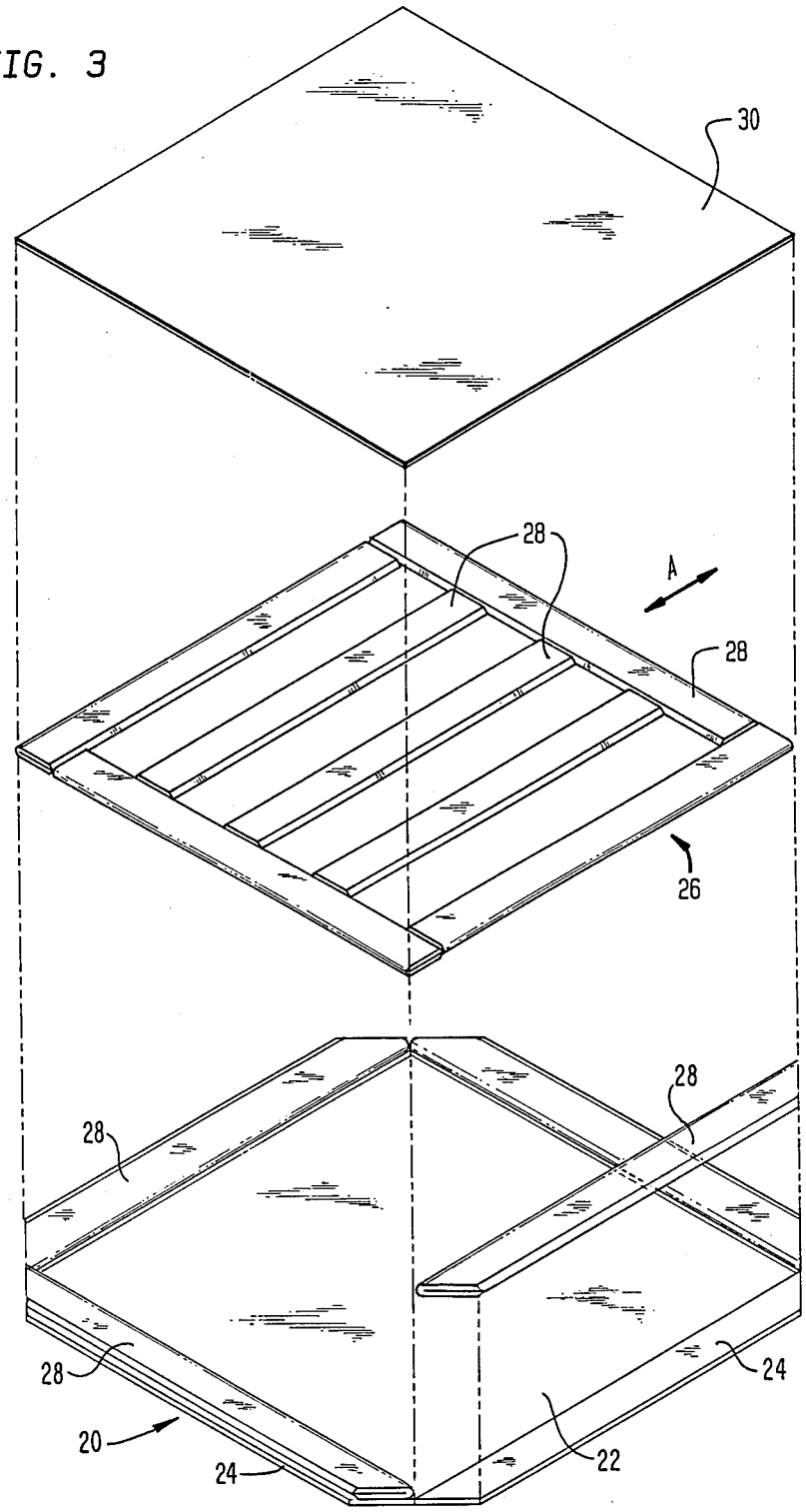
FIG. 3 is a view similar to FIG. 2 showing an alternative construction.

Referring now to FIG. 3, an alternative embodiment is shown differing from that shown in FIG. 2 in two respects. First, additional paperboard slats 28 are provided in the frame 26 to provide additional resistance to the tension of the strap. That is, when straps are applied to the load in either one direction or in two directions, i.e., both across the length and width of the load, the most tension in the strap is in the direction of the first strap tensioned. Thus, additional paperboard slats can be provided in this direction to resist this tension. For example, arrow A in FIG. 3 can represent the direction of the first strap to be tensioned. The additional paperboard slats 28 thus lie in the direction of arrow A providing increased resistance to strap tension.

Second, if desired, the corners of the side flaps 20 can be clipped to facilitate the downward folding of the side flaps.

Figure 5:
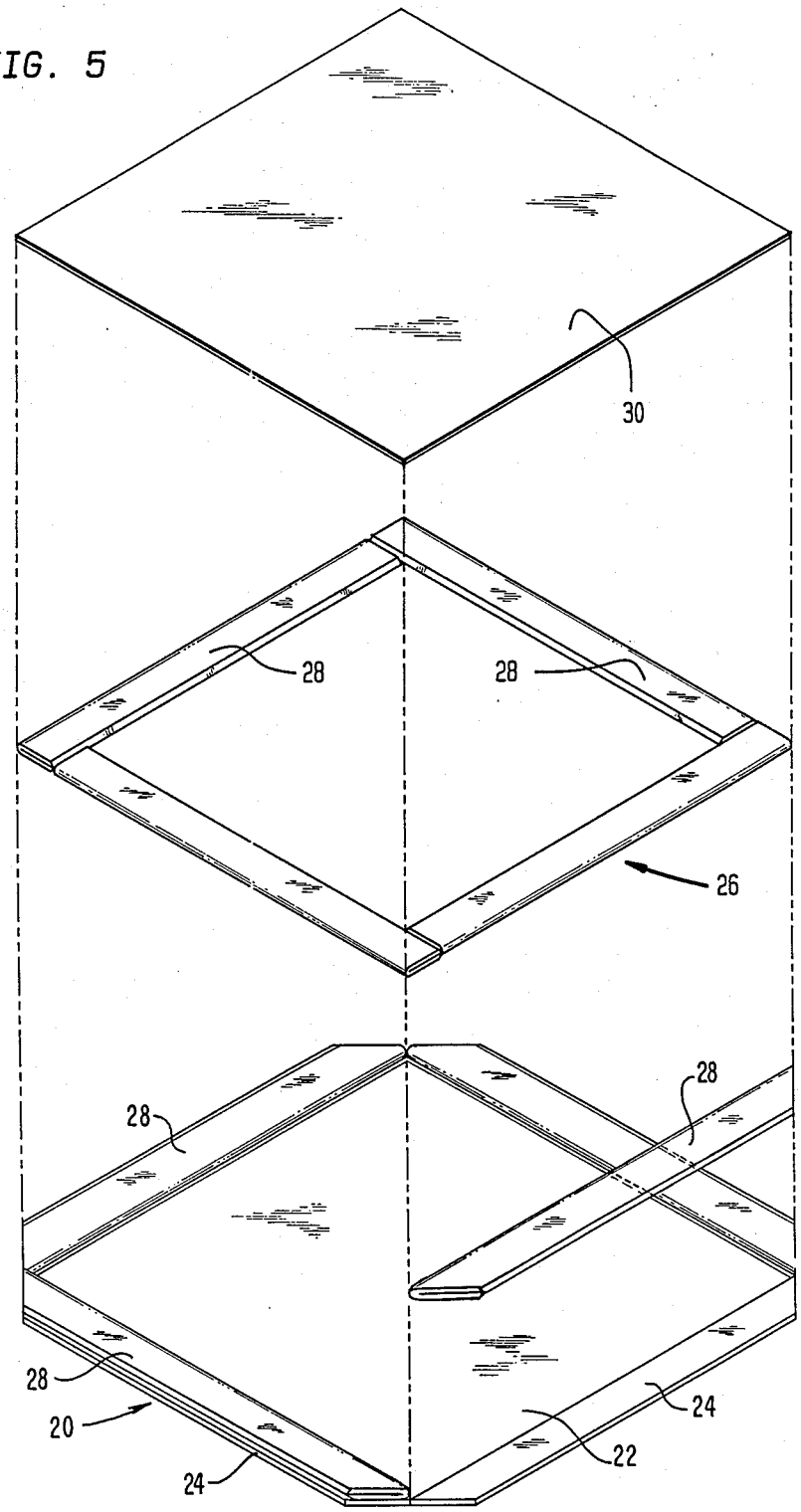
FIG. 5 is a view similar to FIGS. 2 and 3 showing another alternative embodiment of the present invention.

FIG. 5 illustrates in this regard the same embodiment as FIG. 2 with the side flaps 20 likewise clipped to facilitate downward folding of the side flaps 20.

As stated above, a number of alternative forms of the skid top can be adapted depending on the type of load being shipped. For example, when shipping a skid of bottles or cans or anything in cases, side flaps 20 are generally not needed. However, when shipping stacks of paper, printed newspaper advertising inserts, or cartons or the like, the use of side flaps 20 provides substantial protection to abrasion and damage to the paper at the top of the skid. Still further, the side flaps can be of any desired width and can even include more than one paperboard slat such that depending on the width of the load, one or more of the slats can be folded downwardly to conform to the load width.

Still further, in the embodiment shown in FIGS. 1 and 2, the frame 26 and slats 28 adhered to the side flaps 24 of sheet 22 are outside of the load, i.e., the paperboard sheet 22 is interposed between the slats 28 and the load 10. Alternatively, the side flaps 20 could be bent upwardly (sufficient clearance with slats 28 of frame 26 being provided) and the entire top 16 inverted and placed on the load such that slats 28 of frame 26 and side flaps 20 face the load with the sheet 22 being outside thereof. This may be desired in some applications.

Although the invention has been described as used in association with a wood pallet and with strapping passing therearound, it will be appreciated that other forms of packaging could be employed including the use of paperboard slip sheets in place of the pallet and plastic film such as stretch or shrink wrap film in place of the strapping.

Thus having described the invention, what is claimed is:

1. A skid top for protecting a skid load of material comprising:

a paperboard sheet of planar dimension generally corresponding to the length and width of the skid load upon which it is to be used and having a marginal side portion having a planar face, and a peripheral frame of paperboard slats, each said slat comprising a laminated paperboard member folded upon itself and laminated to itself causing opposed planar faces along where it is laminated to itself, one of said opposed planar faces being laminated to the planar face of the marginal side portion of said sheet.

2. A skid top for protecting a skid load of material comprising:

a first paperboard sheet of planar dimension generally corresponding to the length and width of the skid load upon which it is to be used and having a marginal side portion having a planar face, a peripheral frame of paperboard slats, each having opposed planar faces, one of said planar faces being laminated to the planar face of the marginal side portion of said sheet, said slats comprising a laminated paperboard member folded upon itself and laminated to itself, a second paperboard sheet of planar dimension generally corresponding to the planar dimensions of said first sheet laminated to the other of said planar faces of said paperboard slats forming said peipheral frame and sandwiching said frame between said first and second paperboard sheets.

3. A skid top for protecting a skid load of material comprising:

a paperboard sheet of planar dimension generally corresponding to the length and width of the skid load upon which it is to be used and having a marginal side portion and at least a pair of side flaps hinged to the edges of said paperboard sheet adapted to be bent with respect to said paperboard sheet to protect a portion of the sides of said skid load of material, a peripheral frame of paperboard slats laminated to the marginal side portion of said sheet, and a paperboard slat laminated to each said side flap, said slats comprising a laminated paperboard member folded upon itself and laminated to itself.

4. The skid top of claim 3 wherein said paperboard slat includes a rounded edge formed by folding the laminated paper member upon itself and wherein said rounded edge is disposed toward the hinge attaching the side flaps to the paperboard sheet.

5. A skid top for protecting a skid load of material comprising:

a first paperboard sheet of planar dimension generally corresponding to the length and width of the skid upon which it is to be used and having a marginal side portion and at least a pair of side flaps hinged to edges of said paperboard sheet adapted to be bent with respect to said paperboard sheet to protect a portion of the sides of said skid load of material, a peripheral frame of paperboard slats laminated to the marginal side portion of said first sheet, a paperboard slat laminated to each said side flap, said slats comprising a laminated paperboard member folded upon itself and laminated to itself, and a second paperboard sheet of planar dimension generally corresponding to the planar dimension of said first sheet sandwiching said frame between said first and second paperboard sheets and being laminated thereto.

6. The skid top of claim 5 wherein said paperboard slats include a rounded edge formed by folding the laminated paper member upon itself and wherein said rounded edges are disposed toward the hinge attaching the side flaps to the paperboard sheet.

* * * * *

UNITED STATES PATENT AND TRADEMARK OFFICE

CERTIFICATE OF CORRECTION

PATENT NO. : 4,771,885

DATED : September 20, 1988

INVENTOR(S) : Kent A. Linnemann

It is certified that error appears in the above-identified patent and that said Letters Patent is hereby corrected as shown below:

In column 4, line 32, "0.04" should be --0.40--.

Signed and Sealed this

Twenty-eighth Day of February, 1989

*Attest:*

DONALD J. QUIGG

*Attesting Officer*

*Commissioner of Patents and Trademarks*